US008459975B2

(12) United States Patent
Epps

(10) Patent No.: US 8,459,975 B2
(45) Date of Patent: Jun. 11, 2013

(54) STRUCTURAL SURFACE DESIGN DEVICE

(76) Inventor: Ray Allen Jack Epps, Ogden, UT (US)

( * ) Notice: Subject to any disclaimer, the term of this patent is extended or adjusted under 35 U.S.C. 154(b) by 1358 days.

(21) Appl. No.: 11/517,647

(22) Filed: Sep. 8, 2006

(65) Prior Publication Data

US 2008/0124422 A1 May 29, 2008

(51) Int. Cl.
*E04F 21/00* (2006.01)
*B05D 1/28* (2006.01)

(52) U.S. Cl.
USPC ..... 425/12; 425/87; 425/318; 425/403; 425/458; 425/460; 249/104; 249/117; 249/120; 249/140

(58) Field of Classification Search
USPC ..... 425/12, 87, 193, 195, 318, 385, 403, 425/458, 460, 461, 470; 249/102–104, 117, 249/120, 140; 15/104.001, 104.05, 105.5, 15/104.94; 118/211, 212; 101/127.1, 368, 101/405
See application file for complete search history.

(56) References Cited

U.S. PATENT DOCUMENTS

| | | | | | |
|---|---|---|---|---|---|
| 1,789,627 | A * | 1/1931 | Hill | 15/210.5 |
| 3,669,069 | A * | 6/1972 | Bourboulis | 118/102 |
| 3,817,178 | A * | 6/1974 | Hagen | 101/379 |
| 3,910,547 | A * | 10/1975 | Varriano | 249/104 |
| 4,030,414 | A * | 6/1977 | McGuire | 101/379 |
| 4,836,381 | A * | 6/1989 | Edwards et al. | 206/575 |
| 5,203,941 | A * | 4/1993 | Spain et al. | 156/209 |
| 5,811,705 | A * | 9/1998 | Glenn | 84/477 R |
| D419,409 | S * | 1/2000 | Stover et al. | D8/45 |
| 6,231,904 | B1 * | 5/2001 | Mueller | 426/112 |
| 6,287,492 | B1 * | 9/2001 | Goldfarb et al. | 264/40.5 |
| 6,390,801 | B1 * | 5/2002 | Smith | 425/458 |
| 6,507,972 | B2 * | 1/2003 | Hart | 15/210.1 |
| 6,595,768 | B1 * | 7/2003 | Hunsaker | 425/385 |
| 6,604,256 | B1 * | 8/2003 | Pytlewski | 15/235.4 |
| 6,680,083 | B2 * | 1/2004 | Ray et al. | 427/277 |
| 6,756,006 | B1 * | 6/2004 | Levijoki | 264/259 |
| 6,951,435 | B1 * | 10/2005 | Fennessy, Sr. | 404/75 |
| 7,284,293 | B1 * | 10/2007 | Holder et al. | 15/104.94 |
| 7,306,442 | B2 * | 12/2007 | Fox | 425/87 |
| 2002/0001636 | A1 * | 1/2002 | Holloway | 425/385 |

OTHER PUBLICATIONS

Plastic Works Product guide, published on 2003, p. 1.*
Book of Block Impression-Hand Block Printing, p. 1.*
Word document of Specification of Multi Wood Prime, p. 1, 1972.*

* cited by examiner

*Primary Examiner* — Dimple Bodawala
(74) *Attorney, Agent, or Firm* — Fehr Law Firm; Thompson E. Fehr

(57) ABSTRACT

A structural surface design device for creating a design with finishing surface material on a surface, the device having a base with raised projections on the bottom. Such projections have less of an affinity for the finishing surface material than does the surface on which such finishing surface material is to be applied. A handle extends upward from the base. And, optionally, the cross-sectional shape of the base is the same as the cross sectional shape of a container for the finishing surface material with the dimensions of the container and the base being such that the edge of the base, when the base has been inserted into the container, is sufficiently close to the wall or walls of the container that any finishing surface material in said container will not cure.

14 Claims, 1 Drawing Sheet

STRUCTURAL SURFACE DESIGN DEVICE

BACKGROUND OF THE INVENTION

1. Field of the Invention

This invention relates to a tool for creating a finishing design on a surface of a wall or ceiling of a building.

2. Description of the Related Art

Numerous tools have been patented for tools that create designs in finishing surface materials such as joint compound (also called topping), plaster, and stucco. The term "finishing surface material" is defined as including any of these materials.

The tool of U.S. Pat. No. 1,789,627 has a smooth working surface that contains projections the are pressed against an upper wet coat of "paint or plastic material" to remove the portion of the upper wet coat adjacent to each projection from a lower dried coat.

A hand mit having an uneven surface constitutes the device of U.S. Pat. No. 2,811,767. The working surface is pressed into "mortar mix" that has been applied to a panel in order "to obtain a simulated stone texture thereon."

The process of U.S. Pat. No. 5,676,999 involves placing a stencil on surface, applying texture slurry onto the stencil, and removing the stencil. If desire, a trowel "may be lightly drawn across the newly texture area" more closely to match the appearance of an adjacent area.

The tool of U.S. Pat. No. 5,771,525 comprises a plurality of closed-cell polyethylene foam prongs "arranged side-by-side in a bundle, the bundle having a . . . lower end . . . attached to one side of . . . [a] grip, and the top end of the bundle of prongs expanding out in a splay pattern . . . ." In use, the upper ends of the prongs are dipped into "a drywall joint compound, plaster, or stucco material," which is then daubed onto the prepared drywall repair area . . . until the desired area is completely cover[ed]."Consequently, the prongs are not arranged into a pattern that it is desired to duplicate on the surface of the drywall. Furthermore, the prongs do not project from a base that, when the tool is placed into a container of finishing surface material, is sufficiently close to the wall or walls of the container that the material does not cure. The tool does, however, optionally employ an "extension pole" in order to " . . . allow the user to reach ceiling and upper wall locations . . . ."

The texturing tool in U.S. Pat. No. 6,390,801 employs a blade or base having a number of holes for temporarily retaining joint compound that is to applied to a wall by daubing the blade on the wall. From the figures and the claims, it is evident that each of the holes extends "through the tool blade from the first side to an opposite, second side thereof . . . ." Thus, not only does this texturing tool not comprise projections extending from the bottom of the base, but the holes prevent the blade or base from being utilized to prevent curing of the joint compound in a container therefor.

U.S. Pat. No. 6,756,006 describes and claims an applicator unit having an oval cross-sectional shape with a multiplicity of cavities on the bottom to be filled with compound, such as drywall compound, by having the applicator placed in a container, which appears not to be the original container for the compound, having compound therein. The applicator is then pressed against a substrate, such as a ceiling or a wall, to create a desired pattern. The different cross-sectional shapes of the applicator and the container clearly demonstrate that the applicator, when placed in the container, cannot be sufficiently close to the wall or walls of the container that the material does not cure.

The applicator of United States patent publication no. 2002/0001636 is, except for cross-sectional shape and the fact that the applying portion is a sponge, essentially the same as the applicator of Pat. No. 6,756,006 except that the cavities for transfer of the uncured texture material are in a sponge.

And the tool of U.S. Pat. No. 6,680,083 is designed to place designs in an already applied layer of wet plaster. Furthermore, the working surface of the tool is smooth, having neither projections nor cavities.

BRIEF SUMMARY OF THE INVENTION

The Structural Surface Design Device, as depicted in FIG. 1, comprises a base having a top and a bottom. At least one raised projection extends from the bottom of the base creating a pattern for a user to duplicate or repeat with finishing surface material on a structural surface such as a wall or ceiling. The projection or projections and, preferably, the base, are composed of any structural material having an affinity for the finishing surface Material which is less than the affinity for the finishing surface material which the surface to which the material is to be applied has, such structural material preferably being any non-porous material (such as painted wood or plastic), so that the finishing surface material will only removably (not permanently) adhere to the projection or projection when contacted by the projection or projections.

DETAILED DESCRIPTION OF THE INVENTION

In the construction industry, a variety of finishing surface materials 1 are available. These, as mentioned previously, include joint compound (also called "topping") and stucco.

Such materials 1, after application, cure into rigid surfaces. Prior to application, if isolated within a generally airtight container 2, these materials 1 are viscous fluids.

Figure 1:
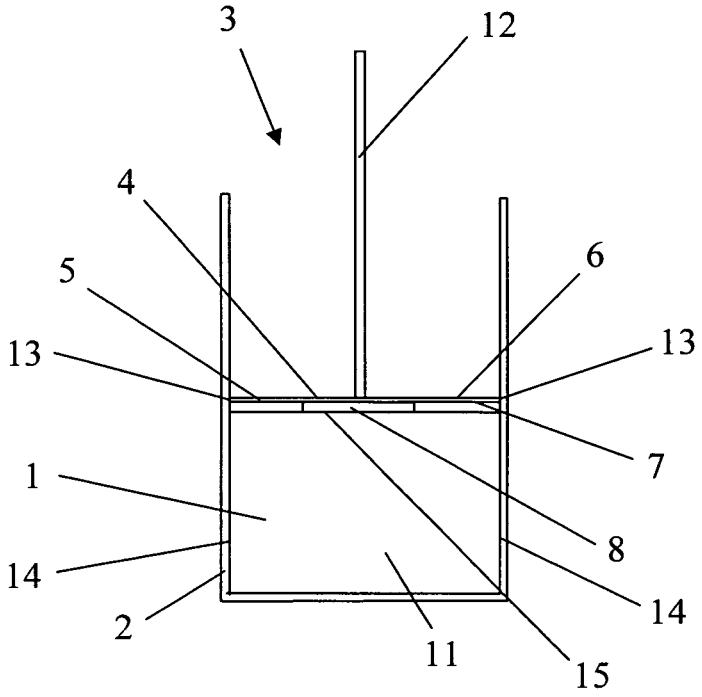
FIG. 1 is a lateral cutaway view of the Structural Surface Design Device in a container of finishing surface material.

The present Structural Surface Design Device 3, as illustrated in FIG. 1, forms a removable top 4 for a container 2 intended to isolate the material prior to application and also selectively extracts material 1 from the container 2 in order to create a design on a desired surface.

The Structural Surface Design Device 3, as depicted in FIG. 1, comprises a base 5 having a top 6 and a bottom 7. At least one raised projection 8 extends from the bottom of the base 5 creating a pattern 9 for a user to duplicate or repeat with finishing surface material 1 on a structural surface such as a wall or ceiling.

Figure 2:
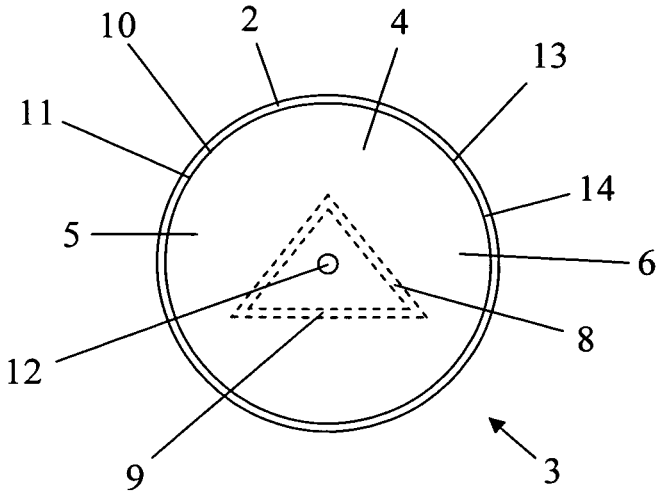
FIG. 2 is a plan view of the top of the base for the Structural Surface Design Device.

As shown in FIG. 2, the cross-sectional shape 10 of the base 5 is preferably the same as that of the interior 11 of the container 2 for the material 1, which is traditionally, but not necessarily, circular (such container 2 generally, but not necessarily, being a bucket).

A handle 12 extends upward from the base 5.

The projection or projections 8 and, preferably, the base 5, are composed of any structural material having an affinity for the finishing surface material 1 which is less than the affinity for the finishing surface material 1 which the surface to which the material is to be applied has, such structural material preferably being any non-porous material (such as painted wood or plastic), so that the finishing surface material 1 will only removably (not permanently) adhere to the projection or projection 8 when contacted by the projection or projections 8.

Preferably, the handle 12, the base 5, and the projection or projections 8 are integrally formed (rather than being created and subsequently attached to one another). And, even more preferably, the handle 12, the base 5, and the projection or projections 8 are composed of plastic (although, when these are not integrally formed, they could each be composed of a different material).

The dimensions of the base 5 are selected such that when the Structural Surface Design Device 3 is placed in the container 2, the edge 13 of the base is sufficiently close to the wall or walls 14 of the container 2 that the material 1 does not cure. Without excessive force being applied to the Structural Surface Design Device 3, only the projection or projections 8 will touch the material 1. Thus, when the Structural Surface Design Device 3 is withdrawn from the container 2, a portion of the material 1 will adhere to the projection or projections 8 but not to any other area of the base 5. Consequently, when the projection or projections 8 are placed sufficiently close to a surface intended to be coated with the material 1, the material 1 on the projection or projections 8 will touch the surface and, upon withdrawal of the projection or projections 8, will, because of the greater affinity of the surface for the material 1, be left on the surface in a pattern 9 having the same shape as that of the lower surface 15 of the projection or projections 8.

I claim:

1. A structural surface design device for creating a design with finishing surface material on a surface, which comprises:

a container for finishing surface material, said container having at least one wall and an interior with a cross-sectional shape and dimensions;

a base having a top, a bottom, a cross-sectional shape, and an edge with the cross-section shape of said base being the same as the cross-sectional shape of said container and with the dimensions of said base being selected such that, when said base is inside said container, the edge of said base is sufficiently close to the every wall of said container that any finishing surface material in said container will not cure;

at least one raised projection extending from the bottom of said base and creating a pattern for a user to duplicate or repeat with finishing surface material on a structural surface, said at least one projection being composed of a structural material having an affinity for finishing surface material which is less than the affinity for finishing surface material which the surface on which the design is to be created has; and a handle extending upward from said base.

2. The structural surface design device for creating a design with finishing surface material on a surface as recited in claim 1, wherein:

said at least one projection is composed of a non-porous material.

3. The structural surface design device for creating a design with finishing surface material on a surface as recited in claim 2, wherein:

the non-porous material of which said at least one projection is composed is painted wood.

4. The structural surface design device for creating a design with finishing surface material on a surface as recited in claim 2, wherein:

the non-porous material of which said at least one projection is composed is plastic.

5. The structural surface design device for creating a design with finishing surface material on a surface as recited in claim 1, wherein:

said base, said handle, and said at least one projection are integrally formed; and said base, said handle, and said at least one projection are composed of a non-porous material.

6. The structural surface design device for creating a design with finishing surface material on a surface as recited in claim 5, wherein:

the non-porous material of which said base, said handle, and said at least one projection are composed is painted wood.

7. The structural surface design device for creating a design with finishing surface material on a surface as recited in claim 5, wherein:

the non-porous material of which said base, said handle, and said at least one projection are composed is plastic.

8. The structural surface design device for creating a design with finishing surface material on a surface as recited in claim 1, wherein:

the cross-section shape of said container and of said base is circular.

9. The structural surface design device for creating a design with finishing surface material on a surface as recited in claim 8, wherein:

said at least one projection is composed of a non-porous material.

10. The structural surface design device for creating a design with finishing surface material on a surface as recited in claim 9, wherein:

the non-porous material of which said at least one projection is composed is painted wood.

11. The structural surface design device for creating a design with finishing surface material on a surface as recited in claim 9, wherein:

the non-porous material of which said at least one projection is composed is plastic.

12. The structural surface design device for creating a design with finishing surface material on a surface as recited in claim 8, wherein:

said base, said handle, and said at least one projection are integrally formed; and said base, said handle, and said at least one projection are composed of a non-porous material.

13. The structural surface design device for creating a design with finishing surface material on a surface as recited in claim 12, wherein:

the non-porous material of which said base, said handle, and said at least one projection are composed is painted wood.

14. The structural surface design device for creating a design with finishing surface material on a surface as recited in claim 12, wherein:

the non-porous material of which said base, said handle, and said at least one projection are composed is plastic.

* * * * *